US008231357B2

(12) United States Patent
Huttar et al.

(10) Patent No.: US 8,231,357 B2
(45) Date of Patent: Jul. 31, 2012

(54) HIGH-PRESSURE COMPRESSOR AND ITS USE AND METHOD FOR OPERATING IT

(75) Inventors: Ernst Huttar, Klosterneuburg (AT); Günther Ognar, Vienna (AT)

(73) Assignee: Leobersdorfer Maschinenfabrik AG, Vienna (AT)

( * ) Notice: Subject to any disclaimer, the term of this patent is extended or adjusted under 35 U.S.C. 154(b) by 461 days.

(21) Appl. No.: 12/159,515

(22) PCT Filed: Jan. 10, 2007

(86) PCT No.: PCT/AT2007/000005

§ 371 (c)(1),
(2), (4) Date: Oct. 1, 2008

(87) PCT Pub. No.: WO2007/079514

PCT Pub. Date: Jul. 19, 2007

(65) Prior Publication Data

US 2009/0269212 A1 Oct. 29, 2009

(30) Foreign Application Priority Data

Jan. 11, 2006 (AT) ..... 42/2006

(51) Int. Cl.
*F04B 23/06* (2006.01)
*F04B 25/00* (2006.01)

(52) U.S. Cl. ..... 417/62; 417/254

(58) Field of Classification Search ..... 417/62, 417/244, 254, 258, 266, 267, 248, 265, 426, 417/521

See application file for complete search history.

(56) References Cited

U.S. PATENT DOCUMENTS

| | | | | |
|---|---|---|---|---|
| 2,042,673 | A * | 6/1936 | Maniscalco | 417/62 |
| 5,577,390 | A * | 11/1996 | Kaido et al. | 62/228.5 |
| 7,409,833 | B2 * | 8/2008 | Unger et al. | 62/196.2 |
| 2003/0108435 | A1 | 6/2003 | Meyer et al. | |

FOREIGN PATENT DOCUMENTS

| | | |
|---|---|---|
| DE | 916 203 | 8/1954 |
| DE | 202 02 190 | 8/2002 |
| FR | 587 743 | 4/1925 |
| FR | 1 239 385 | 8/1960 |
| RU | 2293213 | 2/2007 |

* cited by examiner

*Primary Examiner* — Devon C Kramer
*Assistant Examiner* — Bryan Lettman
(74) *Attorney, Agent, or Firm* — Ladas & Parry LLP

(57) ABSTRACT

A high-pressure compressor (1) for compressing gases, which has at least two working spaces (3, 3') and is optionally adjustable between a single-stage operating position, in which the gas to be compressed is compressed in one single stage, and a multi-stage operating position, in which at least one working space (3') is connected in series with at least one further working space (3), wherein at least three working spaces (3, 3') are provided which all have the same working volume.

15 Claims, 4 Drawing Sheets

HIGH-PRESSURE COMPRESSOR AND ITS USE AND METHOD FOR OPERATING IT

Figure 1:
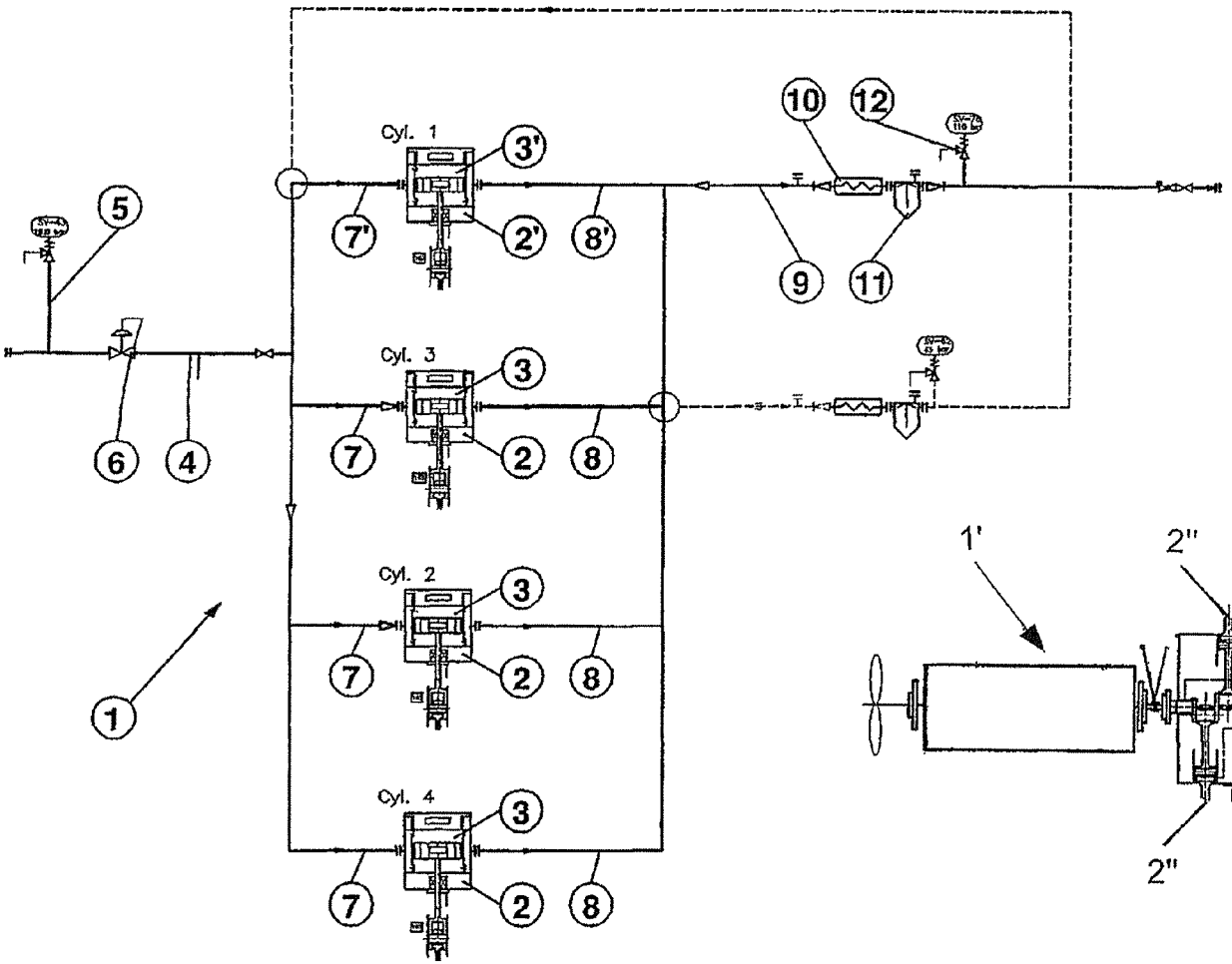

The invention relates to a high-pressure compressor for compressing gases, which has at least two working spaces and is optionally adjustable between a single-stage operating position, in which the gas to be compressed is compressed in one single stage, and a multi-stage operating position, in which at least one working space is connected in series with at least one further working space, as well as to a use of the inventive high-pressure compressor and a method for operating the inventive high-pressure compressor.

In high-pressure compressors, the gas to be compressed is compressed to above 10 bar under inner compression of the gas, wherein high-pressure compressors are designed particularly for introducing gas into high-pressure gas pipelines, via which gas is conveyed usually at a pressure of 70 bar.

High-pressure compressors, in which several working spaces, e.g. cylinders in the case of piston compressors, are arranged in parallel in order to achieve a conveying performance as high as possible, have already been known.

Moreover, high-pressure compressors, in which several compression stages are successively connected in series in order to further compress the gas, which has compressed in the preceding compression stage, in a following compression stage, have been also been known.

From DE 916203 C, a two-stage compressor has already been known, wherein a 3-path switching valve is provided in order to allow for a switch between a parallel and serial arrangement of two compressors.

In EP 1340919 A, a method for controlling several separate flow machines is described. Here, each flow machine has a separate driving machine, wherein the flow machines, connected in parallel, of a low-pressure stage, a mean-pressure stage and a high-pressure stage may be connected in series. In order to be able to omit a so-called master controller for the combined parallel and serial connection, one machine controller is associated to each flow machine, and a common process size is directly input into the respective machine controller for controlling the flow machines cooperating in one station. Thus, the EP document relates to a different method, with no optional switching of individual working spaces between a single-stage and multi-stage operating position being provided for.

In EP 0431287 A, also a different control for several compressors is described, yet with compressors being connected either in parallel or series.

Furthermore, with different vacuum pumps, e.g. as described in DE 102 49 062 A1, it has been known to pump out recipients of atmospheric pressure to a desired final vacuum of about $10^{-2}$ mbar, wherein due to the small pressure differences no substantial inner compression of the gas to be pumped is effected with vacuum pumps. Here, with respect to an efficient pump-out procedure, it has been known to provide for a two-stage vacuum pump, wherein, at the start, the two pistons present suck in parallel and only at a pressure prevailing in the recipient, at which the gases sucked by means of the pistons can no longer be provided at atmospheric pressure, the pistons previously connected in parallel are connected in series.

From DE 202 02 190 U1, also a vacuum pump is described which differs from high-pressure compressors, wherein, here, in particular a special valve block is disclosed for switching between a parallel and serial connection. Also here, just a vacuum pump is provided which can be used only at a pressure level in the mbar region.

In view thereof, it is an object of the present invention to provide for a high-pressure compressor of the initially defined kind, by means of which gases that have a strongly differing pressure level on the input side of the high-pressure compressor can be compressed to a high pressure of particularly up to 70 bar in a manner as effective as possible.

With the high-pressure compressor of the initially defined kind this is achieved in that at least three working spaces are provided which all have the same working volume. In particular, it is advantageous if four or five working spaces are provided. With usual high-pressure compressors, in which several working spaces are connected in parallel to each other and which, thus, have a larger conveying volume, e.g. in the case of natural gas, a compression ratio of about 1:5 at the most can be achieved. Accordingly, with such high-pressure compressors, it is only possible to introduce natural gas present at a pressure of up to about 15 bar into high-pressure gas pipelines which usually have a pressure level of 70 bar. With the inventive high-pressure compressor, wherein there is the possibility to optionally choose between a single-stage operation and a multi-stage operation, at least one working space can be connected in series when a certain pressure level has been reached on the input side of the high-pressure compressor, so that a higher final compression can be achieved which, in particular, also allows for an introduction of the compressed gas into a high-pressure gas pipeline. Here, a compression as efficient as possible is reached by providing working spaces that have the same working volume, i.e. a high conveying performance is achieved in the single-stage operation in which all working spaces may be connected in parallel. At the same time, a high efficiency may be reached in the multi-stage operation at a compression ratio of particularly 1:3 or 1:4 by providing three, in particular four or five, working spaces. Thus, a compression as efficient as possible of the gas to be compressed may be achieved both in the single-stage operation and in the multi-stage operation by providing at least three working spaces with the same working volume.

In order to achieve a conveying performance as high as possible in the single-stage operation, it is advantageous if all working spaces are connected in parallel with each other in the single-stage operating position.

In order to achieve a compression as efficient as possible at a compression ratio of 1:3 or 1:4, it is advantageous if, in the multi-stage operating position, three or four working spaces are connected in parallel and one working space is connected in series to the other working spaces.

A high-pressure compressor which is simple in construction and offers high efficiency is the case if a piston compressor is provided so that cylinders are provided as working spaces. Of course, compressors of different types with separated working spaces could also be provided, such as, e.g., screw compressors, turbo compressors, blowers or the like.

For a constructionally simple possibility for selective adjustment between a single-stage and a multi-stage operation, it is advantageous if at least one valve, in particular a 3-path valve, is provided in at least one gas line for switching between the single-stage operating position and the multi-stage operating position.

In order to connect a working space, which is connected in parallel in the single-stage operation in a simple manner, so as to follow the other working spaces in the multi-stage operation it is beneficial if a valve is arranged in one of at least two gas supply lines of the working spaces, said gas supply lines being connected in parallel in the single-stage operating position, and if a further valve is arranged in one of the at least two gas output lines of the working spaces, said gas output lines being connected in parallel in the single-stage operating position. Here, for an automatic change between the single-stage operation and the multi-stage operation, it is advantageous if the valves for changing between the single-stage operating position and the multi-stage operating position are driven electrically, pneumatically or hydraulically.

In order to achieve a change from the single-stage operating position to the multi-stage operating position in a simple manner by switching the valves, it is beneficial if a connecting line is provided, via which, in the multi-stage operating position, the gas output line of a working space is connected with the gas supply line of a further working space.

If a cooling device is arranged in the connecting line, a certain portion of gas of the gas compressed in the first compression stage in the multi-stage operation can be condensed; here, it is beneficial if a condensate separator is arranged in the connecting line so as to separate the condensate from the gas provided for further compression. Likewise, due to the internal compression of the gas in the high-pressure compressor it it is advantageous if a cooling device is arranged in a central gas output line, wherein it is advantageous for separating the condensate produced by the aid of the cooling device if a condensate separator is arranged in a central gas output line.

The invention further relates to a use of the inventive high-pressure compressor for arrangement in a connecting line between a gas removal reservoir with an input pressure, which is reducing from an initial pressure, and a gas receiving reservoir with a constant pressure level substantially corresponding to the initial pressure, wherein the high-pressure compressor at first is adjusted in the single-stage operating position, and when the input pressure is declining, the high-pressure compressor is switched into the multi-stage operating position for maintaining the output pressure at a constant level. Here, the gas removal reservoir may in particular be a section of a high-pressure gas pipeline, which has to be repaired, e.g. because of a leakage, or has to be cleaned or the like. In remote areas where no mean-pressure gas line system of 12 bar or 30 bar and no low-pressure gas line system of about from 35 to 50 mbar is available, all of the gas accumulated in the closed off portion of the gas pipeline is fed to the surroundings at an initial pressure of 70 bar. By using the inventive high-pressure compressor in a connecting line, which interconnects, e.g. two high-pressure pipeline sections, almost all of the gas present in the close-off section can be compressed by the aid of the inventive high-pressure compressor and may thus again be introduced into the high-pressure gas pipeline.

In order to allow for the high-pressure compressor to be used for such pressures in this context, it is beneficial if the output pressure is substantially 70 bar.

If the high-pressure compressor is switched to the multi-stage operating position at an input pressure of between 10 bar and 20 bar, preferably of substantially 15 bar, at first a compression as efficient as possible will be achieved in the single-stage operation at an output pressure of from 70 bar to about ⅕th of the output pressure, and, thereafter, a change to the multi-stage operation may be done to reach the desired high-pressure compression in a manner as efficient as possible.

Furthermore, the invention relates to a method for operating the inventive high-pressure compressor, wherein the input pressure of the high-pressure compressor is detected, and when the input pressure falls short of a pre-defined value, the compressor is automatically switched from the single-stage operating position into the multi-stage operating position. Thereby, the most efficient operating position of the high-pressure compressor is selected in each case, no manual steps being necessary.

Figure 1A:
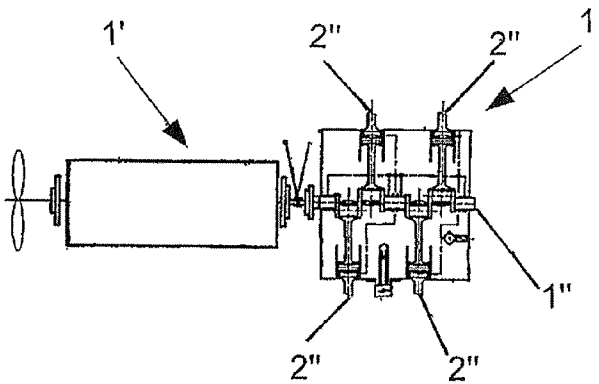
Figure 2:
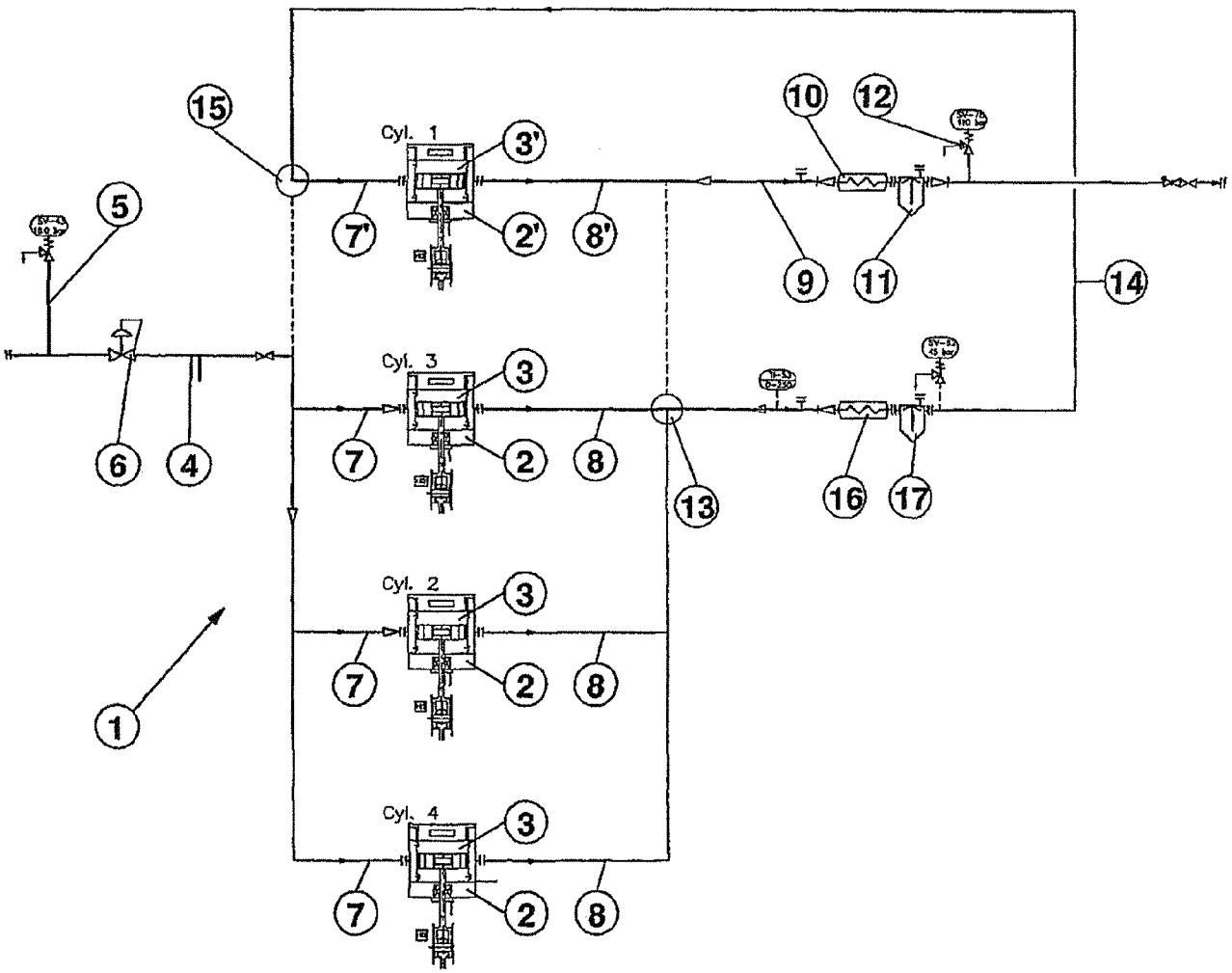
Figure 3:
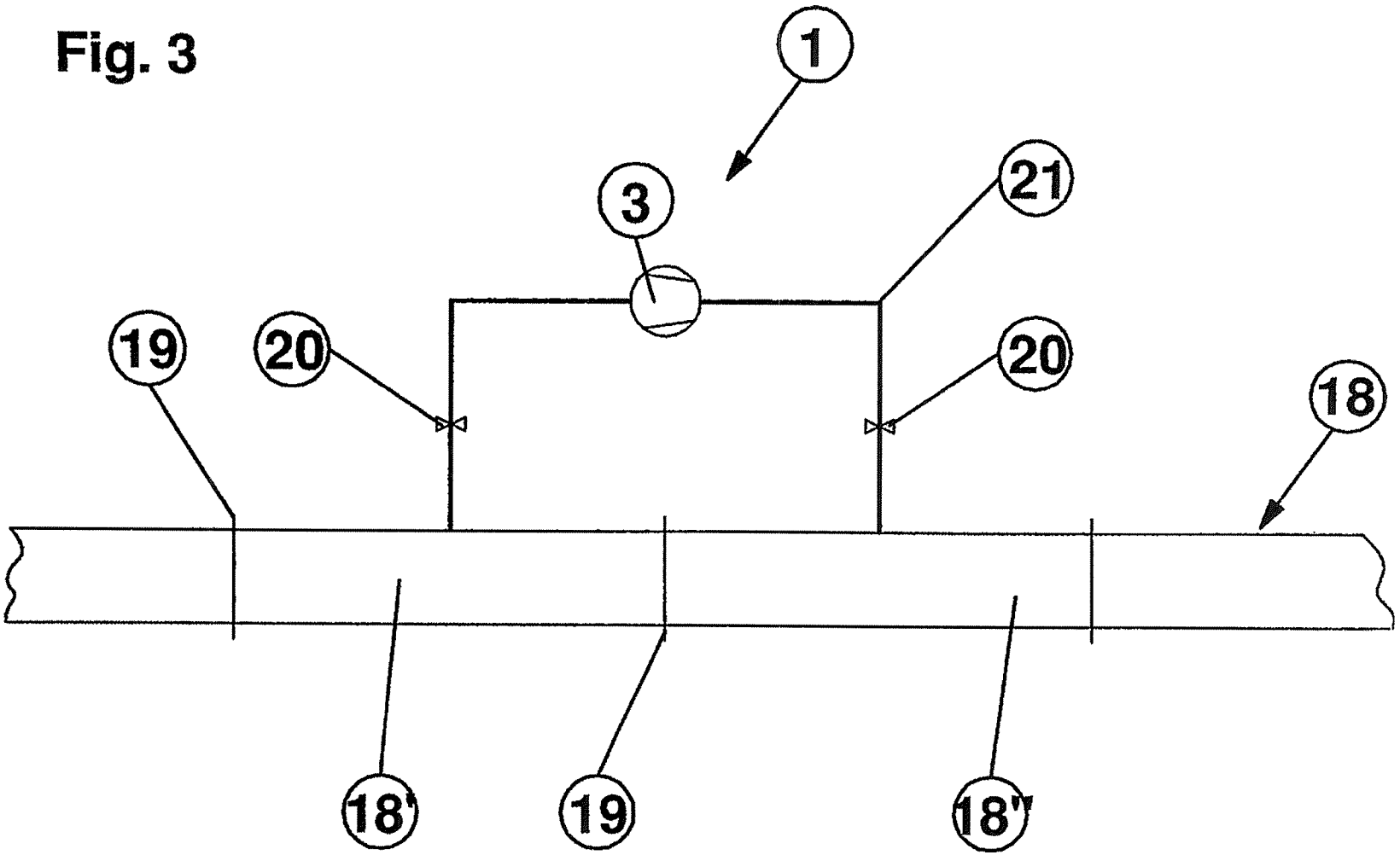
Figure 4:
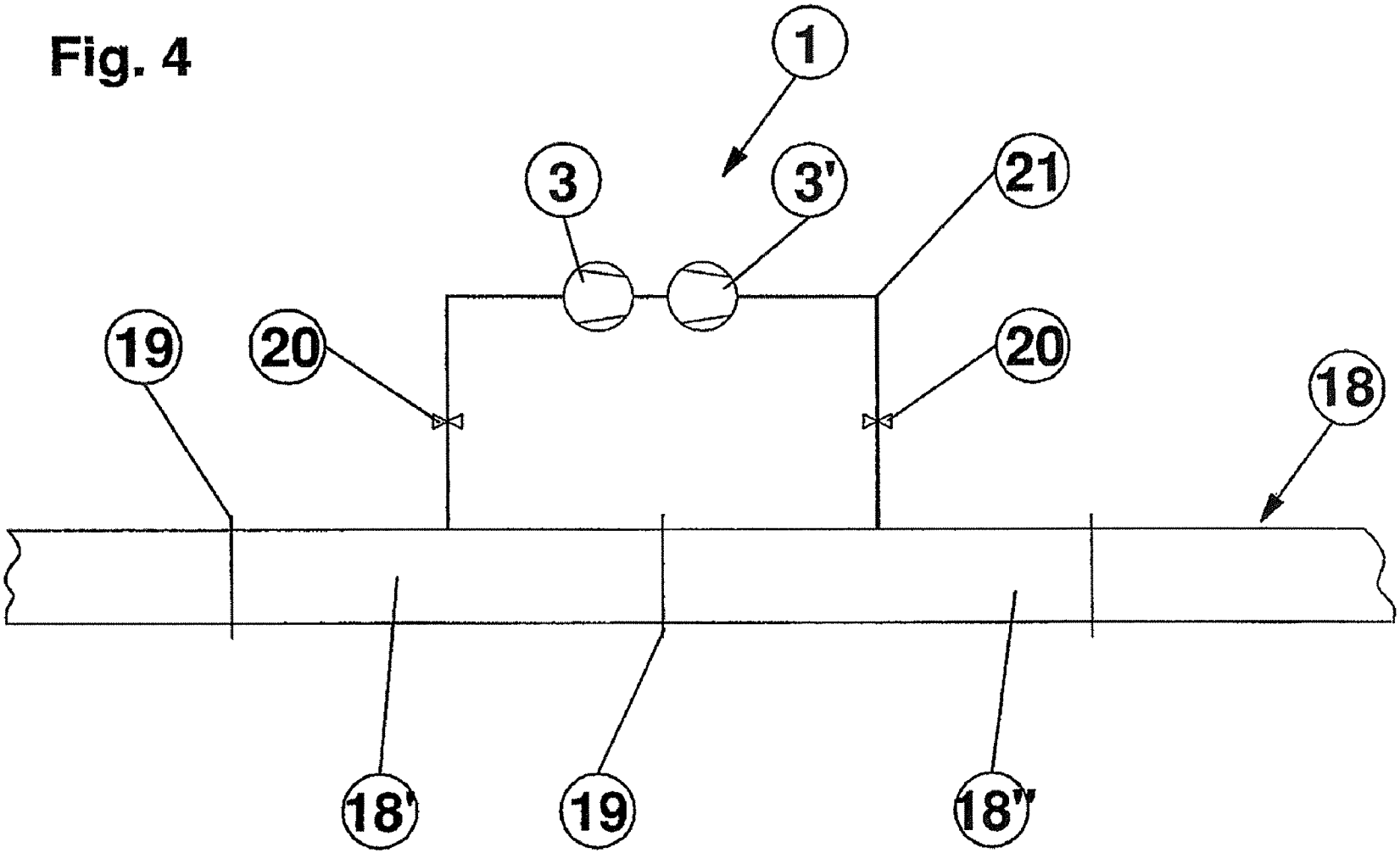

In the following, the invention will be explained in even more detail by way of a preferred exemplary embodiment illustrated in the drawing, yet without being restricted thereto. In detail, in the drawing:

FIG. 1 schematically shows high-pressure compressor 1 with four cylinders connected in parallel to each other;

FIG. 1*a* schematically shows a view of a driving unit of the high-pressure compressor;

FIG. 2 schematically shows a high-pressure compressor 1 according to FIG. 1, wherein a cylinder is connected in series to the other cylinders;

FIG. 3 schematically shows a use of the high-pressure compressor according to FIGS. 1 and 2 in a connecting line of two sections of a gas pipeline in the single-stage operation;

FIG. 4 schematically shows a use of the high-pressure compressor according to FIG. 3 in the two-stage operation.

In the operating position of a high-pressure compressor 1 shown in FIG. 1 the working spaces 3, 3' and the piston compressors 2, 2' are connected in parallel to each other such that there is only one single compression stage. As can be seen from FIG. 1*a*, the piston rods 2", each being associated to a working space 3, 3', are driven via a common crankshaft 1" of a common driving unit 1'. Here, the gas to be compressed is introduced into the working spaces 3, 3' in a parallel fashion via a gas input line 4, a gas discharge line 5 and a pressure restriction valve 6 being arranged therein, via gas supply lines 7, 7' and, thereafter, said gas is conveyed to a central gas output line 9 via gas output lines 8, 8', a cooling device 10 as well as a condensate separator 11 and a gas discharge line 12 being provided in the central gas output line 9.

In this operating position, the high-pressure compressor 1 may produce the highest conveying performance, wherein, however, due to the single-stage operation the possible compression ratio is limited to a ratio input pressure to output pressure of about 1:5 in the case of natural gas.

In order to achieve a higher compression with the same high-pressure compressor 1, the latter may be switched to the multi-stage operating position shown in FIG. 2 in a simple manner. Here, a 3-path valve 13 is provided in a gas output line 8, via which valve the gas output lines 8 of the piston compressors 2 connected in parallel to each other may be connected to a connecting line 14. In the multi-stage operating position, the connecting line 14 is additionally connected with the input line 7' of the piston compressor 2' by the aid of a 2 or 3-path valve 15, so that the gas output lines 8 of the three piston compressors 2 connected in parallel to each other communicate with the gas input line 7' of the piston compressor 2' and, thus, a serial operation mode of the individual working spaces 3, 31 may be achieved in a simple manner by switching the valves 13, 15.

In this context, a cooling device 16 and a condensate separator 17 are provided in the connecting line 14 to cool the gas which, in the first compression stage in the working spaces 3, is subjected to an inner compression, and to separate the condensate produced, thus achieving a more efficient further compression in the piston cylinder 21 arranged to follow thereafter.

In the exemplary embodiment shown, in this context, four piston compressors 2, 2', each having identical working spaces 3 or 3', are shown so that an efficient compression is achieved both in the parallel single-stage operation and the multi-stage operation, since the pre-compressed gas is subsequently compressed in a further working space 3' in the multi-stage operation, said further working space comprising only one third of the working volume of the first compression stage, thus obtaining an efficient compression ratio of 1:3 in the second compression stage.

In FIGS. 3 and 4, the special use of the high-pressure compressor 1 schematically shown in FIGS. 1 and 2 is shown together with a high-pressure natural gas pipeline 18. Such high-pressure gas pipelines 18 are installed in particular also in very remote areas where no parallel low-pressure gas network is available, into which the gas conveyed in the high-pressure gas pipeline 18 could be discharged. Here, such high-pressure gas pipelines have line sections 18', 18" which may be separated from each other via close-off means 19 at a certain distance of usually about 18.64 miles (30 km). If in remote regions a leakage occurs or a cleaning or the like is necessary in the natural gas pipeline 18 in the region of the line section 18', the line section 18' will usually be separated from the rest of the gas pipeline 18 via close-off means 19, and the gas present in the line section 18' is discharged to the surroundings via valve 20 at an initial pressure of 70 bar. In order to avoid the discharge to the surroundings, a high-pressure compressor 1 is shown in FIG. 1 which is connected with the valves 20 of the line sections 18', 18" via a connecting or bypass line 21 and which, at the start of the conveyance of natural gas via a connecting line 21, is at first operated in the single-stage operation shown in FIG. 1, as can be seen in FIG. 3. If only natural gas with a pressure of about 15 bar has accumulated in the line section 18', no further natural gas may be introduced into the line section 18', in which a pressure of about 70 bar prevails, in the single-stage operation due to the limited compression ratio of about 1:5. Accordingly, as can be seen in FIG. 4, by switching the valves 13 and 15 (cf. FIG. 2), the working space 3' is connected in series to the other working spaces 3, thus achieving a lower conveying performance while obtaining a higher compression.

By changing to the multi-stage operating position shown in FIGS. 2 and 4, up to a pressure of about 2-3 bar, natural gas may be introduced from the line section 18' into the line section 18" at about 70 bar. Of course, it would also be conceivable to provide for one further or several further compression stages to introduce the gas present in the line section 18' at an even lower pressure into the line section 18" at about 70 bar.

The invention claimed is:

1. A high-pressure compressor for compressing natural gas which is optionally adjustable between a single-stage operating position, in which the natural gas to be compressed is compressed in one single stage, and a multi-stage operating position, with four or five working spaces, each of which has a same working volume, wherein, in the single-stage operating position, all of the working spaces are connected to each other in parallel and, in the multi-stage operating position, three or four of the working spaces are connected in parallel and a single remaining working space is connected in series with the three or four working spaces to provide for a compression ratio of 1:3 or 1:4, the high-pressure compressor comprising at least one valve in at least one gas line for switching between the single-stage operating position and the multi-stage operating position.

2. The high-pressure compressor according to claim 1, comprising cylinders as working spaces.

3. The high-pressure compressor according to claim 1, wherein the at least one valve comprises a valve arranged in one of at least two gas supply lines of the working spaces, said gas supply lines being connected in parallel in the single-stage operating position, and wherein the at least one valve comprises a further valve arranged in one of at least two gas output lines of the working spaces, said gas output lines being connected in parallel in the single-stage operating position.

4. The high-pressure compressor according to claim 1, wherein the at least one valve is electrically, pneumatically or hydraulically driven for switching between the single-stage operating position and the multi-stage operating position.

5. The high-pressure compressor according to claim 1, comprising a connecting line via which a gas output line of said single remaining working space is connected with a gas supply line of said three or four working spaces in the multi-stage operating position.

6. The high-pressure compressor according to claim 5, wherein a cooling device is arranged in the connecting line.

7. The high-pressure compressor according to claim 6, wherein a condensate separator is arranged in the connecting line.

8. The high-pressure compressor according to claim 1, wherein a cooling device is arranged in a central gas output line.

9. The high-pressure compressor according to claim 8, wherein a condensate separator is arranged in a central gas output line.

10. A method comprising arranging the high-pressure compressor of claim 1 in a connecting line between a natural gas removal reservoir with an input pressure, which is reducing from an initial pressure, and a natural gas receiving reservoir with a constant pressure level substantially corresponding to the initial pressure, and adjusting the high-pressure compressor in the single-stage operating position, in which all of the working spaces are connected to each other in parallel, and when the input pressure is declining, switching the high-pressure compressor into the multi-stage operating position.

11. The method according to claim 10, wherein an output pressure is substantially 70 bar.

12. The method according to claim 10, comprising switching the high-pressure compressor to the multi-stage operating position when the input pressure is between 10 and 20 bar.

13. The method according to claim 12, wherein the switching of the high-pressure compressor to the multi-stage operating position is when the input pressure is substantially 15 bar.

14. A method for operating the high-pressure compressor of claim 1, comprising detecting an input pressure of the high-pressure compressor and when the input pressure falls short of a pre-defined value, automatically switching from the single-stage operating position into the multi-stage operating position.

15. The high-pressure compressor according to claim 1, wherein the at least one valve is a 3-path valve.

* * * * *